United States Patent [19]

Okamoto et al.

[11] Patent Number: 4,586,966

[45] Date of Patent: May 6, 1986

[54] METHOD OF PRODUCING COLD-ROLLED STEEL SHEET EXHIBITING IMPROVED PRESS-FORMABILITY

[75] Inventors: Atsuki Okamoto, Ashiya; Masashi Takahashi, Kawanishi, both of Japan

[73] Assignee: Sumitomo Metal Industries, Ltd., Osaka, Japan

[21] Appl. No.: 591,815

[22] Filed: Mar. 21, 1984

[30] Foreign Application Priority Data

Mar. 25, 1983 [JP] Japan ..... 58-049996

[51] Int. Cl.[4] ..... C21D 7/02; C21D 9/46; C21D 9/48

[52] U.S. Cl. ..... 148/12 C; 148/12 D

[58] Field of Search ..... 148/12 C, 12 D, 36, 148/12 R, 12.4; 164/463, 479, 480, 481, 444

[56] References Cited

U.S. PATENT DOCUMENTS

| | | | |
|---|---|---|---|
| 4,331,488 | 5/1982 | Sudo et al. | 148/36 |
| 4,441,936 | 4/1984 | Takahashi et al. | 148/12 C |
| 4,480,373 | 11/1984 | Geskin | 164/444 |

FOREIGN PATENT DOCUMENTS

| | | | |
|---|---|---|---|
| 73825 | 6/1980 | Japan | 148/12 D |
| 43824 | 3/1984 | Japan | 148/12 R |
| 43825 | 3/1984 | Japan | 148/12 R |
| WO82/01893 | 6/1982 | PCT Int'l Appl. | 148/12 C |

*Primary Examiner*—Wayland Stallard

*Attorney, Agent, or Firm*—Burns, Doane, Swecker & Mathis

[57] ABSTRACT

A method of producing a cold-rolled steel sheet having improved press-formability without employing hot rolling is disclosed. The method comprises preparing a molten steel having the following chemical composition:

C: 0.001–0.015%,
Mn: 0.01–1.20%,
sol.Al: not more than 0.10%
N: not more than 0.0060%, at least one element selected from the group consisting of Ti: not more than 0.20%,
Nb: not more than 0.20% and
Zr: not more than 0.20%, and the balance iron and incidental impurities, with the following Formulas being satisfied:

$$\text{Ti-equivalent} = \text{Ti}(\%) + 48/93\ \text{Nb}(\%) + 48/91\ \text{Zr}(\%) \quad (1)$$

$$\text{C-equivalent} = \text{C}(\%) + 12/14\ \text{N}(\%) \quad (2)$$

$$(\text{C-equivalent}) - \tfrac{1}{4}(\text{Ti-equivalent}) \leqq 0.0010(\%) \quad (3),$$

rapidly cooling the thus prepared molten steel to continuously produce a thin cast plate, coiling the thus produced plate at a temperature of 500°–800° C., and applying cold rolling and then recrystallization annealing to the cast plate after uncoiling.

10 Claims, 1 Drawing Figure

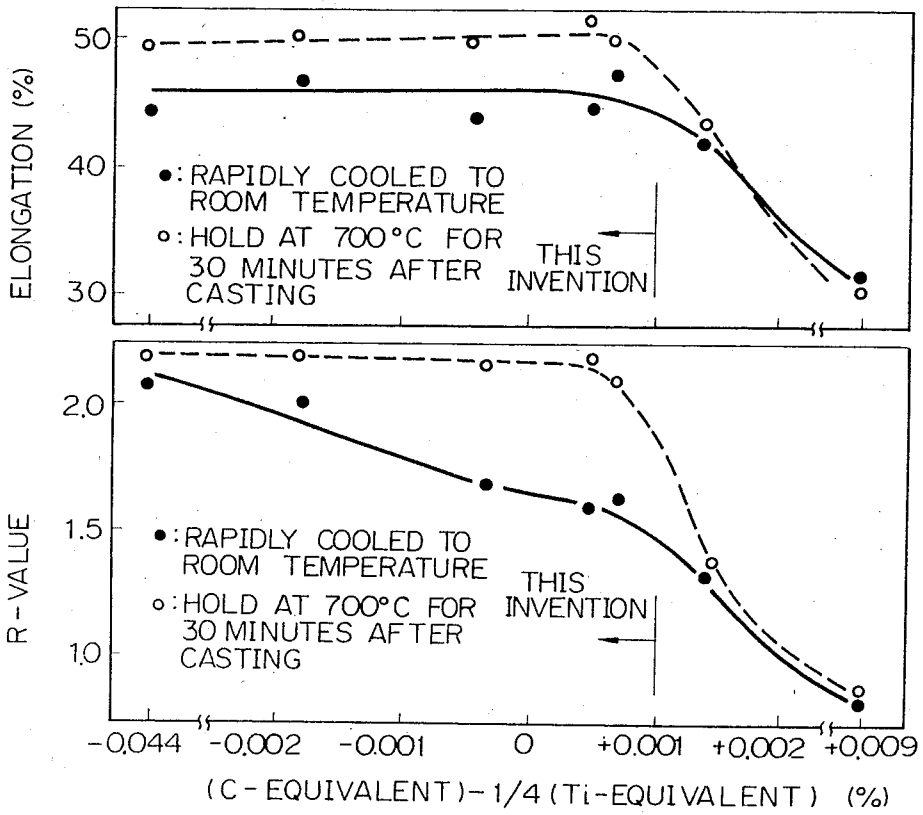
ELONGATION (%)
50
40
30
●: RAPIDLY COOLED TO ROOM TEMPERATURE
○: HOLD AT 700°C FOR 30 MINUTES AFTER CASTING
THIS INVENTION
R-VALUE
2.0
1.5
1.0
●: RAPIDLY COOLED TO ROOM TEMPERATURE
○: HOLD AT 700°C FOR 30 MINUTES AFTER CASTING
THIS INVENTION
-0.044
-0.002
-0.001
0
+0.001
+0.002
+0.009
(C-EQUIVALENT)-1/4 (Ti-EQUIVALENT) (%)

METHOD OF PRODUCING COLD-ROLLED STEEL SHEET EXHIBITING IMPROVED PRESS-FORMABILITY

BACKGROUND OF THE INVENTION

This invention relates to a method of producing cold-rolled steel sheet exhibiting improved press-formability, and more particularly to a method of producing the same at a lower cost.

In the prior art, in order to produce cold-rolled steel sheet for use in press-forming, first a completely solidified slab is prepared using a continuous casting process, the thus obtained slab is then cooled to ambient temperature, and the cooled slab is charged into a heating furnace kept at 1100°-1300° C. after surface inspection and removal of any surface flaws. After soaking in the heating furnace for from 30 minutes to one hour, the hot slab is passed to hot rolling. The resulting hot-coil is then cold rolled and subjected to annealing.

Recently it has become possible to continuously cast slabs with the surfaces being completely free of surface flaws and other damage. In addition, greater emphasis is being placed on saving energy in the steel industry, and many proposals have been made in order to achieve reductions in energy costs. For example, it has been proposed that a continuously cast slab be charged into a heating furnace before cooling to ambient temperature, and after soaking in the heating furnace without any substantial application of additional heat, be subjected to hot rolling followed by cold rolling and annealing. This proposal has actually been put into effect.

However, from the viewpoint of further saving energy, improving the handling of cast slabs or the like, and improving rolling operations, it is more desirable to eliminate the steps of charging the slab into a heating furnace, i.e. soaking and hot rolling. Thus, it is most advantageous to supply a continuously-cast plate directly to cold rolling. One of the drawbacks encountered when such a process is put into practice is that cast slabs essentially have a columnar structure, i.e. a cast structure which will suffer from surface roughening when cold rolling with a considerable reduction in thickness is carried out. The surface appearance of the resulting cold-rolled sheet will be impaired remarkably. The other serious problem is that the drawability of the steel sheet obtained through cold rolling followed by annealing greatly deteriorates in comparison with that of conventional cold-rolled steel sheet. Therefore, the process mentioned above has not yet been put into practice on an industrial scale.

OBJECT OF THE INVENTION

The object of this invention is to provide a method of producing a cold-rolled steel sheet having improved press-formability at a lower cost.

SUMMARY OF THE INVENTION

The inventors of this invention carried out a series of experiments with the aim of finding a practical method of producing cold-rolled steel sheet having improved press-formability as well as an improved surface appearance produced by subjecting a cast plate directly to cold rolling without carrying out soaking and hot rolling. During the investigations, the inventors learned the following: (1) It is important to reduce not only the yield stress of steel sheet, but also the crystal grain size prior to cold rolling in order to improve the surface appearance of a cold-rolled steel sheet.

In order to do so, it is necessary to restrict the carbon content of the steel to not more than 0.015% by weight (unless otherwise indicated, "%" in this specification means "% by weight").

Thus, the transformation to a delta-phase (δ-phase) takes place during solidification, which can be transformed into a gamma-phase (γ-phase) at lower temperatures to produce fine gamma-particles. In addition, in order to prevent crystal growth during transformation from the delta-phase into the gamma-phase or after completion of transformation into the gamma-phase, it is advisable to add a suitable amount of Ti, Zr, or Nb, which combine with nitrogen inevitably present in the steel to form TiN, ZrN, or NbN. The precipitation of these nitrides can successfully prevent the crystal growth of gamma-particles in the solidified cast plate to preserve fine gamma-particles. (2) The Ti-equivalent and C-equivalent defined by the following Formulas (1) and (2), respectively, should satisfy the relationship shown by Formula (3) below:

$$\text{Ti-equivalent} = \text{Ti}(\%) + 48/93\text{Nb}(\%) + 48/91\text{Zr}(\%) \quad (1)$$

$$\text{C-equivalent} = \text{C}(\%) + 12/14\text{N}(\%) \quad (2)$$

$$(\text{C-equivalent}) - \tfrac{1}{4}(\text{Ti-equivalent}) \leqq 0.0010\% \quad (3)$$

The inventors have found that when a steel composition satisfies the above mentioned relationship, it is easy to introduce into a cast structure mobile dislocations in an amount sufficient to make the steel easily deformable, so that a cold-rolled steel sheet with satisfactory surface appearance may be produced successfully. When Formula (3) is not satisfied, the density of mobile dislocations introduced during solidification is low, and the resulting cold-rolled steel sheet inevitably suffers from considerable surface roughening. (3) As is well known in the art, a cast structure, when rapidly solidified, contains a number of crystal grains which have <100> axes in the normal direction with respect to the sheet surface. According to conventional processes, the {100} texture structure is thoroughly destroyed during hot rolling to provide a hot-rolled steel sheet having substantially no texture structure but having crystal grains dispersed in random directions. The thus prepared hot-rolled steel sheet is then cold rolled to increase the number of crystal grains having <111> axes in the normal direction with respect to the sheet surface. The amount of {111} texture structure increases accordingly. Furthermore, utilizing the precipitation of AlN in the course of recrystallization, it is possible to further increase the amount of the {111} texture structure.

Thus, an increase in the amount of {111} texture structure can improve deep drawability indicated in terms of the r-value of an annealed cold-rolled steel sheet. That is, press-formability can be improved by increasing the amount of the {111} texture structure.

However, in case hot rolling is not applied, a cast plate having the {100} texture structure has to be subjected to cold rolling so that the formation of the {111} texture structure is suppressed during cold rolling. Thus, a relatively large amount of {100} texture structure which deteriorates deep drawability remains. The resulting cold-rolled steel sheet contains a large amount of {100} texture structure and a relatively small amount of {111} texture structure even after being subjected to annealing.

In addition, since solid solution treatment of AlN prior to cold rolling is not carried out when hot rolling is eliminated, it is difficult to promote the development of the {111} texture structure utilizing the precipitation of AlN during the recrystallization step.

However, when the carbon-equivalent shown by Formula (2) and the titanium-equivalent shown by Formula (1) satisfy the relationship shown by Formula (3), plastic deformation during cold rolling easily takes place, the {111} texture structure easily forms in the steel structure, and the formation of the {111} texture structure can successfully be promoted without the precipitation of AlN during annealing. (4) Even if the carbon equivalent and titanium equivalent satisfy the relationship given by Formula (3) above, the degree of precipitation and growth of carbides such as TiC, NbC, ZrC etc. are not enough to achieve the purpose of this invention when the cast plate is once cooled to ambient temperature after solidification. This is because if the cast plate is cooled to ambient temperature, the cooling will result in less formation or growth of crystal grains during recrystallization annealing, resulting in less formation of the {111} texture structure.

Thus, when a thin cast plate just after solidification is coiled at a temperature of 500°–800° C. and then is gradually cooled, the formation and growth of the carbides are successfully promoted, resulting in a very active formation of the {111} texture structure during recrystallization annealing.

The inventors of this invention have achieved the present invention in the light of the findings mentioned above.

BRIEF DESCRIPTION OF THE DRAWING

The attached drawing is a graph showing the relationship between the value of (Carbon-equivalent—$\frac{1}{4}$Titanium-equivalent) and the elongation or r-value of cold-rolled steel sheets.

SUMMARY OF THE INVENTION

This invention resides in a method of producing a cold-rolled sheet having improved press-formability, which comprises preparing a molten steel having the following chemical composition:

C: 0.001–0.015%,
Mn: 0.01–1.20%,
sol. Al: not more than 0.10%,
N: not more than 0.0060%, at least one element selected from the group consisting of:
Ti: not more than 0.20%,
Nb: not more than 0.20%, and
Zr: not more than 0.20%, and/or at least one element selected from the group consisting of:
V: 0.01–0.20%, P: 0.03–0.10%,
Cr: 0.05–1.00%,
Rare earth metals: 0.03–0.20%,
B: 0.0003–0.0040%, and
Si: 0.10–2.00%, and the balance iron and incidental impurities, with the Ti-equivalent defined by the following Formula (1) and the C-equivalent defined by the following Formula (2) satisfy the relationship defined by the following Formula (3):

$$\text{Ti-equivalent} = \text{Ti}(\%) + 48/93\text{Nb}(\%) + 48/91\text{Zr}(\%) \quad (1)$$

$$\text{C-equivalent} = \text{C}(\%) + 12/14\text{N}(\%) \quad (2)$$

$$(\text{C-equivalent}) - \tfrac{1}{4}(\text{Ti-equivalent}) \leqq 0.0010(\%) \quad (3),$$

rapidly cooling the thus prepared molten steel to continuously produce a thin cast plate, coiling the thus produced plate at a temperature of 500°–800° C., and applying cold rolling and then recrystallization annealing to the cast plate after uncoiling.

Thus, according to this invention a cold-rolled steel sheet having improved press-formability can be obtained efficiently at a lower cost without employing reheating or a soaking treatment and hot rolling.

DETAILED DESCRIPTION OF THE PREFERRED EMBODIMENTS

The reasons for defining the steel composition employed in this invention as in the above will now be described.

C (Carbon):

The lower the carbon content is, the better the press-formability of a cold-rolled steel sheet. Therefore, it is desirable to restrict the carbon content to as low a level as possible. However, when the carbon content is lower than 0.001%, it is extremely difficult to prepare a molten steel on an industrial scale. On the other hand, when the carbon content is more than 0.015%, it is necessary to incorporate a large amount of a carbo-nitride former such as Ti, Nb, and Zr, resulting in precipitation of a large amount of carbo-nitrides, which impairs the press-formability of the resulting steel sheet. According to a preferred embodiment of this invention, the carbon content is defined as 0.001–0.015%, more preferably 0.001–0.010%.

Mn (Manganese):

Manganese is effective to improve the toughness of a steel sheet to be obtained in accordance with this invention. A manganese content of less than 0.01% is insufficient to improve toughness. When it is higher than 1.20%, it is difficult to prepare molten steel. Moreover, the incorporation of a large amount of Mn adds to manufacturing costs.

Thus, according to this invention the manganese content is defined as 0.01–1.20%.

sol. Al (soluble Aluminum):

Aluminum is optionally added to carry out deoxidation of a melt so that the yield of a carbo-nitride former is increased. The content of sol. Al, when it is added, is restricted to not more than 0.10%. When it is incorporated in an amount of more than 0.10%, deoxidation is not promoted any further, and the manufacturing cost is increased. According to this invention, therefore, the upper limit of sol. Al is defined as 0.10%.

N (Nitrogen):

The lower the nitrogen content, the smaller the Ti-equivalent, i.e. the amount of a carbo-nitride former, which is required to be added in an amount as small as possible. Therefore, the lower the nitrogen content, the better. Since the addition of nitrogen in an amount of more than 0.0060% impairs the press-formability of the final product, the upper limit of nitrogen is defined as 0.0060%. Ti, Nb and Zr (Titanium, Niobium and Zirconium):

These elements, when added, form fine carbo-nitrides in a cast plate to increase the number of mobile dislocations after solidification. Thus, the addition of these elements is effective to improve the surface appearance of a cold-rolled steel sheet. The incorporation of these elements is also effective to form {111} texture in the final product, improving press-formability, i.e. deep-drawability indicated in terms of an r-value. However, when each of these elements is added in an amount of more than 0.20%, no further improvement can be expected, and the addition of a large amount of these elements adds to manufacturing costs. Therefore, according to this invention, the upper limit of each of these elements is defined as 0.20%.

Formulas (1), (2), and (3) shown hereinbefore are introduced so as to ensure that the amount of (C+N) which is dissolved in the steel is not more than 0.0010%, and that the remaining (C+N) is precipitated in the form of carbo-nitrides.

The reason why the upper limit of the value of Formula (3) for (C-equivalent)$-\frac{1}{4}$(Ti-equivalent) is defined as 0.0010% is that when the value is larger than 0.0010%, the amount of (C+N) dissolved in the steel increases, and the surface appearance and press-formability of the resulting cold-rolled steel sheet markedly deteriorate.

Since these elements should be distributed uniformly throughout the structure, it is preferable to employ a rapid cooling method in continuous casting which can successfully prevent the segregation of these element during solidification.

V, P, Cr, Rare Earths, B, and Si:

The incorporation of these elements is effective to improve the strength of steel sheet and/or to homogenize the resulting steel sheet. They are optionally added to the steel of this invention. The lower limit each on these elements is:

V: not less than 0.01%,
P: not less than 0.03%,
Cr: not less than 0.05%,
Rare Earths: not less than 0.03%,
B: not less than 0.0003%, and
Si: not less than 0.10%.

When these elements are added in amounts over their upper limits, the weldability and/or surface appearance of the resulting steel deteriorate. The upper limit of each of these elements is:

V: not more than 0.20%,
P: not more than 0.10%,
Cr: not more than 1.00%,
Rare Earths : not more than 0.20%,
B: not more than 0.0040%, and
Si: not more than 2.00%.

According to this invention, a steel the chemical composition of which is as mentioned hereinbefore is cast and rapidly cooled to continuously form a thin cast plate. The continuously cast thin plate is then coiled at a temperature of 500°-800° C., preferably 600°-750° C. and gradually cooled to ambient temperature. After that, the steel plate is subjected to cold rolling and recrystallization annealing. The temperature at which the cast plate is coiled is such that the growth of carbides may be thoroughly promoted without preventing the formation of {111} texture structure in the course of recrystallization.

Generally, a lower coiling temperature may be employed when a relatively large amount of Ti, Nb, and/or Zr is added. When a small amount of these elements is incorporated, the coiling should be carried out at a relatively high temperature. In particular, when Ti, Zr and/or Nb are in the ranges defined in this invention, the coiling temperature is preferably in the range of 500°-800° C. When the temperature is lower than 500° C., the growth of carbides is not sufficient to improve the r-value of the resulting cold-rolled steel sheet. On the other hand, when the temperature is higher than 800° C., the crystal grains grow prior to cold rolling, resulting in a decrease in the r-value.

The thin cast plate, when a further improved surface appearance is required, is subjected to surface treatment to remove surface defects and/or scales after coiling and then is passed to cold rolling. The reduction in thickness through cold rolling is preferably 50% or more. The larger the reduction in thickness, the more the press-formability is improved.

The cold rolling is preferably carried out at a temperature below 450° C.; otherwise the {111} texture structure is not developed during cold rolling and thus prevents the formation of the {111} texture structure in the course of recrystallization.

In the subsequent recrystallization annealing, the recrystallization is carried out by means of a continuous annealing process or a continuous dip-plating process. Box-annealing may also advantageously be employed. The temperature of annealing for recrystallization is preferably between 650° C. and 950° C.

Skin pass rolling is preferably applied after the recrystallization annealing especially when the surface roughness or the adjustment of the yield strength of the sheet product is required.

This invention will be further described in conjunction with the following working examples, which are presented merely for illustrative purposes and do not restrict this invention in any way.

EXAMPLE 1

A variety of steels having the compositions (Ti: 0-0.20%) shown in Table 1 were melted in vacuo and were cast into thin cast plates 10 mm thick, 110 mm wide and 100 mm long. Two plates of each steel were prepared and one was quenched to ambient temperature after casting and the other was charged into a heating furnace at 700° C. for 30 minutes and then gradually cooled to ambient temperature. The latter simulated coiling at a temperature of 700° C.

After pickling, the cast plates were subjected to cold rolling with a reduction in thickness of 92% to provide a cold rolled steel sheet 0.8 mm thick and then were subjected to a continuous annealing treatment at a temperature of 800° C. for 90 seconds.

After annealing, test pieces (JIS No. 5 test piece) were cut from each of these cold-rolled steel sheets and were used to determine the r-value and elongation. The test results were plotted in the attached drawing with respect to the amount of carbon dissolved in the steel, i.e. the value of Formula (3): (C-equivalent)$-\frac{1}{4}$(Ti equivalent).

As is apparent from the data shown in the attached drawing, a cold-rolled steel sheet with a high r-value as well as satisfactory elongation properties can be obtained when the value of Formula (3) is not more than 0.0010% and cast plate is charged into the heating furnace at 700° C. for 30 minutes after casting.

TABLE 1

| (% by weight) | | | | | | | |
|---|---|---|---|---|---|---|---|
| C | Si | Mn | P | S | sol. Al | N | Ti |
| 0.006 | 0.01 | 0.08 | 0.010 | 0.001 | 0.05 | 0.004 | 0–0.20 |

EXAMPLE 2

A steel having the chemical composition shown in Table 2 below was prepared in vacuo and was cast into long thin cast plates 10 mm thick and 50 mm wide. The plates were then rapidly cooled to 200°-900° C., coiled, charged into a heating furnace kept at the temperature and then gradually cooled from the temperature to ambient temperature. The cooling rate was about 40° C./hr.

The Ti-equivalent of this steel was 0.034%, the C-equivalent was 0.0070%, and it satisfied the relationship shown by Formula (3).

After the skin surface was ground away, the coils were cold rolled to a thickness of 1.2 mm with a reduction in thickness of 85% and then were subjected to continuous annealing at 850° C. for 30 seconds. These sheets were subjected to skin pass rolling with an elongation of 0.6%. From the thus obtained cold-rolled steel sheet, specimens (JIS No. 5 test piece) were cut and used to determine mechanical properties of the steel.

The test results are summarized in Table 3 below.

As is apparent from the data shown in Table 3, the cold-rolled steel sheet produced in accordance with this invention shows a high r-value, a satisfactory elongation, and improved press-formability in comparison with steel sheet obtained through a process in which the coiling temperature falls outside the range defined in this invention.

The surface properties of the steel sheet manufactured in accordance with this invention process are not so degraded as those of conventional cold-rolled steel sheets.

TABLE 2

| (weight %) | | | | | | | |
|---|---|---|---|---|---|---|---|
| C | Si | Mn | P | S | sol. Al | N | Zr |
| 0.0040 | 0.010 | 0.28 | 0.011 | 0.007 | 0.045 | 0.0035 | 0.065 |

TABLE 3

| Coiling temp. (°C.) | Mechanical Properties | |
|---|---|---|
| | r-value | Elongation (%) |
| 200 | 1.90 | 46.0 |
| 400 | 2.00 | 50.0 |
| 500 | 2.20 | 52.0 |
| 700 | 2.45 | 53.0 |

TABLE 3-continued

| Coiling temp. (°C.) | Mechanical Properties | |
|---|---|---|
| | r-value | Elongation (%) |
| 800 | 2.25 | 52.0 |
| 900 | 1.85 | 47.0 |

EXAMPLE 3

Steels having the compositions shown in Table 4 below were prepared in vacuo and cast into thin cast plates 40 mm thick, 220 mm wide, and 440 mm long. The cast plates were heated at a temperature of 700° C. for 20 minutes and then gradually cooled.

After the plates were descaled, they were cold-rolled to a thickness of 1.2 mm with a reduction in thickness of 97% and were subjected to a continuous annealing treatment at a temperature of 800° C. for 90 seconds to obtain cold-rolled steel sheets No. 1 to 19 and comparative cold-rolled steel sheets No. 20-24. Tensile strength and r-values were determined for these steel sheets. The test results are summarized in Table 4. In Table 4 the asterik marks show the cases in which the content of the indicated element is outside the range of this invention.

As is apparent from the data shown in Table 4, the cold-rolled steel sheet obtained in accordance with this invention had an improved r-value, i.e. improved press-formability.

In contrast, the comparative steel sheets No. 20 and 21 in which the values of Formula (3) were well over the range of this invention had a low r-value and less improved press-formability.

Although the value of Formula (3) for Comparative Specimens No. 22 and 24 were within the range of this invention, Specimen No. 22 contained a carbon content higher than that of this invention and Specimen No. 24 contained a nitrogen content higher than that of this invention.

In addition, comparative cold-rolled sheet No. 23 was a conventional P-containing Al-killed steel sheet and did not contain carbo-nitride formers. Therefore, the r-value was small.

Although the invention has been described with preferred embodiments, it is to be understood that variations may be employed without departing from the cencept of the invention as defined in the appended claims.

TABLE 4

| Steel | | Chemical Composition (% by weight) | | | | | | | | | |
|---|---|---|---|---|---|---|---|---|---|---|---|
| | | C | Mn | sol. Al | N | Ti | Nb | Zr | V | P | Cr |
| This Invention | 1 | 0.0020 | 0.10 | 0.10 | 0.0060 | 0.18 | — | 0.17 | — | — | — |
| | 2 | 0.0030 | 0.20 | 0.05 | 0.0032 | — | — | 0.06 | — | — | — |
| | 3 | 0.0090 | 0.98 | 0.01 | 0.0011 | — | 0.18 | 0.02 | — | — | — |
| | 4 | 0.0140 | 0.12 | 0.09 | 0.0060 | 0.13 | 0.04 | 0.10 | 0.20 | — | — |
| | 5 | 0.0050 | 0.12 | 0.03 | 0.0021 | — | 0.08 | — | — | 0.100 | — |
| | 6 | 0.0040 | 0.45 | 0.08 | 0.0011 | 0.03 | 0.02 | — | — | — | 0.90 |
| | 7 | 0.0062 | 0.82 | 0.02 | 0.0012 | 0.10 | 0.12 | — | — | — | — |
| | 8 | 0.0050 | 0.10 | 0.01 | 0.0060 | 0.50 | — | 0.10 | — | — | — |
| | 9 | 0.0110 | 0.05 | 0.01 | 0.0028 | 0.03 | — | 0.04 | — | — | — |
| | 10 | 0.0140 | 0.63 | 0.01 | 0.0052 | 0.08 | — | 0.10 | 0.10 | 0.052 | — |
| | 11 | 0.0060 | 0.02 | <0.001 | 0.0010 | — | 0.05 | 0.10 | — | — | 0.06 |
| | 12 | 0.0090 | 0.12 | 0.03 | 0.0011 | — | 0.18 | — | — | — | — |
| | 13 | 0.0010 | 0.03 | 0.08 | 0.0042 | 0.04 | 0.04 | 0.10 | 0.03 | — | 0.12 |
| | 14 | 0.0042 | 0.43 | 0.09 | 0.0030 | 0.19 | 0.18 | 0.03 | 0.10 | 0.080 | — |
| | 15 | 0.0010 | 0.05 | 0.02 | 0.0012 | 0.03 | 0.15 | 0.01 | 0.04 | 0.042 | — |
| | 16 | 0.0100 | 0.20 | 0.02 | 0.0060 | — | — | 0.18 | — | 0.040 | 0.68 |
| | 17 | 0.0110 | 0.13 | 0.03 | 0.0028 | 0.03 | — | 0.04 | 0.02 | 0.086 | — |
| | 18 | 0.0140 | 0.04 | 0.04 | 0.0037 | 0.19 | — | — | 0.08 | — | 0.18 |
| | 19 | 0.0083 | 0.90 | 0.03 | 0.0040 | 0.10 | 0.05 | 0.05 | 0.11 | 0.034 | 0.10 |
| Comparative | 20 | 0.0050 | 0.12 | 0.003 | 0.0018 | — | — | 0.03 | — | — | — |
| | 21 | 0.0030 | 0.40 | 0.053 | 0.0043 | — | — | — | — | — | — |

TABLE 4-continued

| | | | | | | | | | | | |
|---|---|---|---|---|---|---|---|---|---|---|---|
| | 22 | 0.0200* | 0.31 | 0.040 | 0.0044 | 0.15 | — | — | — | — | — |
| | 23 | 0.0400 | 0.17 | 0.020 | 0.0025 | — | — | — | — | 0.058 | — |
| | 24 | 0.0040 | 0.72 | 0.088 | 0.0068* | — | — | 0.16 | — | — | 0.80 |

| Steel | | Chemical Composition (% by weight) REM | B | Si | *1 (%) | *2 (%) | *3 (%) | Tensile Strength (kgf/mm²) | r-value |
|---|---|---|---|---|---|---|---|---|---|
| This Invention | 1 | — | — | — | 0.2697 | 0.0071 | <0 | 33.0 | 2.15 |
| | 2 | — | — | — | 0.0316 | 0.0057 | <0 | 31.2 | 2.20 |
| | 3 | — | — | — | 0.1034 | 0.0099 | <0 | 38.3 | 2.40 |
| | 4 | — | — | — | 0.2033 | 0.0191 | <0 | 39.5 | 2.05 |
| | 5 | — | — | — | 0.0413 | 0.0008 | <0 | 44.6 | 2.15 |
| | 6 | — | — | — | 0.0775 | 0.0049 | <0 | 38.4 | 2.10 |
| | 7 | 0.20 | — | — | 0.1619 | 0.0072 | <0 | 33.0 | 2.58 |
| | 8 | — | 0.0040 | — | 0.1027 | 0.0101 | <0 | 30.6 | 2.62 |
| | 9 | — | — | 1.85 | 0.0511 | 0.0134 | 0.0006 | 49.6 | 2.08 |
| | 10 | — | — | — | 0.1327 | 0.0185 | <0 | 40.0 | 2.11 |
| | 11 | 0.05 | — | — | 0.0785 | 0.0069 | <0 | 34.6 | 2.30 |
| | 12 | — | 0.0005 | 0.15 | 0.0929 | 0.0099 | <0 | 48.0 | 2.01 |
| | 13 | 0.06 | — | — | 0.1134 | 0.0046 | <0 | 40.5 | 2.22 |
| | 14 | — | — | 0.30 | 0.2829 | 0.0068 | <0 | 41.8 | 2.18 |
| | 15 | 0.03 | 0.0030 | — | 0.1127 | 0.0020 | <0 | 36.0 | 2.36 |
| | 16 | — | 0.0010 | 0.92 | 0.1002 | 0.0151 | <0 | 48.6 | 2.06 |
| | 17 | 0.18 | 0.0030 | 0.43 | 0.0511 | 0.0134 | 0.0006 | 44.0 | 2.18 |
| | 18 | 0.10 | — | 1.52 | 0.1900 | 0.0172 | <0 | 53.2 | 2.03 |
| | 19 | 0.16 | 0.0006 | 0.26 | 0.1522 | 0.0117 | <0 | 47.1 | 2.11 |
| Comparative | 20 | — | — | — | 0.0158 | 0.0065 | 0.0026* | 32.8 | 1.42 |
| | 21 | — | — | — | 0 | 0.0065 | 0.0065* | 34.0 | 1.21 |
| | 22 | — | — | — | 0.1500 | 0.0238 | <0 | 34.6 | 1.58 |
| | 23 | — | — | — | 0 | 0.0421 | 0.0421* | 43.0 | 1.31 |
| | 24 | — | — | — | 0.0844 | 0.0098 | <0 | 34.9 | 1.70 |

Note:
*1: Ti-equivalent,
*2: C-equivalent,
*3: (C-equivalent) - ¼(Ti-equivalent)

What is claimed is:

1. A method of producing a cold-rolled steel sheet having improved press-formability, which comprises preparing a molten steel having the following chemical composition:

C: 0.001–0.015%,
Mn: 0.01–1.20%,
sol. Al: not more than 0.10%,
N: not more than 0.0060%, at least one element selected from the group consisting of:
Ti: not more than 0.20%,
Nb: not more than 0.20%, and
Zr: not more than 0.20%, and the balance iron and incidental impurities, with the Ti-equivalent defined by the following Formula (1) and the C-equivalent defined by the following Formula (2) satisfying the relationship defined by Formula (3) below:

$$\text{Ti-equivalent} = \text{Ti}(\%) + 48/93\text{Nb}(\%) + 48/91\text{Zr}(\%) \quad (1)$$

$$\text{C-equivalent} - \text{C}(\%) + 12/14\text{N}(\%) \quad (2)$$

$$(\text{C-equivalent}) - \tfrac{1}{4}\,(\text{Ti-equivalent}) \leqq 0.0010\ (\%) \quad (3)$$

rapidly cooling the thus prepared molten steel to continuously produce a thin cast plate, coiling the thus produced plate at a temperature of 500°–800° C., and applying cold rolling and then recrystallization annealing to the cast plate after uncoiling said method being carried out without a hot rolling step.

2. The method defined in claim 1, in which skin pass rolling is carried out after the recrystallization annealing.

3. The method defined in claim 1, in which the carbon content is 0.001–0.010%.

4. The method defined in claim 1, in which the annealing temperature for recrystallization is 650°–950° C.

5. The method defined in claim 1, in which the cold rolling is carried out with a reduction in thickness of 50% or more.

6. A method of producing a cold-rolled steel sheet having improved press-formability, which comprises preparing a molten steel having the following chemical composition:

C: 0.001–0.015%,
Mn: 0.01–1.20%,
sol. Al: not more than 0.10%
N: not more than 0.0060%, at least one element selected from the group consisting of:
Ti: not more than 0.20%,
Nb: not more than 0.20%, and
Zr: not more than 0.20%, at least one element selected from the group consisting of:
V: 0.01–0.20%, P: 0.03–0.10%,
Cr: 0.05–1.00%,
Rare earth metals: 0.03–0.20%,
B: 0.0003–0.0040%, and
Si: 0.10–2.00%, and the balance iron and incidental impurities, with the Ti-equivalent defined by the following Formula (1) and the C-equivalent defined by the following Formula (2) satisfying the relationship defined by Formula (3) below:

$$\text{Ti-equivalent} = \text{Ti}(\%) + 48/93\text{Nb}(\%) + 48/91\text{Zr}(\%) \quad (1)$$

$$\text{C-equivalent} = \text{C}(\%) + 12/14\text{N}(\%) \quad (2)$$

$$(\text{C-equivalent}) - \tfrac{1}{4}(\text{Ti-equivalent}) \leqq 0.0010(\%) \quad (3),$$

rapidly cooling the thus prepared molten steel to continuously produce a thin cast plate, coiling the thus produced plate at a temperature of 500°–800° C., and applying cold rolling and then recrystallization annealing to the cast plate after uncoiling.

7. The method defined in claim 6, in which skin pass rolling is carried out after the recrystallization annealing.

8. The method defined in claim 6, in which the carbon content is 0.001–0.010%.

9. The method defined in claim 6, in which the annealing temperature for recrystallization is 650°–950° C.

10. The method defined in claim 6, in which the cold rolling is carried out with a reduction in thickness of 50% or more.

* * * * *